US007275409B1

(12) United States Patent
Wu et al.

(10) Patent No.: US 7,275,409 B1
(45) Date of Patent: Oct. 2, 2007

(54) METHOD FOR MANUFACTURING A HEAT PIPE HAVING AN ENLARGED PORTION

(75) Inventors: Chung Wu, Taipei (TW); Meng-Cheng Huang, Taipei (TW); Tony Wang, Taipei (TW)

(73) Assignee: Chaun-Choung Technology Corp., Taipei (TW)

( * ) Notice: Subject to any disclaimer, the term of this patent is extended or adjusted under 35 U.S.C. 154(b) by 0 days.

(21) Appl. No.: 11/404,791

(22) Filed: Apr. 17, 2006

(51) Int. Cl.
*B21D 26/02* (2006.01)

(52) U.S. Cl. ..... 72/370.22; 72/370.1; 72/370.24; 29/890.032

(58) Field of Classification Search ..... 72/370.22, 72/370.02, 370.1, 370.23, 370.24, 370.26, 72/370.12, 367.1, 368, 466.7, 57; 29/890.032, 29/421.1
See application file for complete search history.

(56) References Cited

U.S. PATENT DOCUMENTS 3,680,189 A * 8/1972 Noren ..... 29/890.032
2005/0235494 A1* 10/2005 Chuang et al. ..... 29/890.032

FOREIGN PATENT DOCUMENTS

JP 01181935 A * 7/1989

* cited by examiner

*Primary Examiner*—Derris H. Banks
*Assistant Examiner*—Debra M Wolfe

(57) ABSTRACT

A method for manufacturing a heat pipe having an enlarged portion includes the steps of: preparing a hollow tubular material having a uniform outer diameter; forming the tubular material with an enlarged portion having a different or larger outer diameter by narrowing or enlarging the tubular material; arranging a capillary structure into the tubular material; filling a working fluid into the tubular material after sealing one end of the tubular material; sealing the end to form a heat pipe after performing a degassing operation; and pressing the enlarged portion obtained in the previous step to form a flattened enlarged portion on the heat pipe.

8 Claims, 5 Drawing Sheets

METHOD FOR MANUFACTURING A HEAT PIPE HAVING AN ENLARGED PORTION

BACKGROUND OF THE INVENTION

1. Field of the Invention

The present invention relates to a method for manufacturing a heat pipe having an enlarged portion. Especially, the present invention aims to manufacture a tubular heat pipe, thereby to increase the contacting area between the heat pipe and a heat-conducting plate or an electronic heat-generating element.

2. Description of Prior Art

In a conventional tubular heat pipe, the condensed end thereof is usually connected to a plurality of heat-dissipating fins, and the heated end thereof is brought into contact with a heat-conducting plate or an electronic heat-generating element. In terms of the performance of heat transfer, the heated end should be brought into contact with the heat-conducting plate and the electronic heat-generating element as much as possible to increase the contacting area. Therefore, traditionally, the tubular heat pipe is directly made flattened by performing a pressing process for subsequent use. However, since in most cases the outer diameter of the original heat pipe is 8 mm, the surface area of the flattened section after pressing is not large enough. As a result, although the tubular heat pipe is preferable in terms of shape, there is still room for improvement.

Therefore, in view of the above drawbacks, the inventor proposes the present invention to overcome the above problems based on his expert experiences and deliberate researches.

SUMMARY OF THE INVENTION

The present invention is to provide a method for manufacturing a heat pipe having an enlarged portion, characterized in that: before being formed into a heat pipe, a hollow tubular material having a uniform outer diameter is formed with an enlarged portion having a larger outer diameter by narrowing or enlarging the tubular material; when the tubular material is filled with a working fluid and formed into a heat pipe after performing a degassing operation, the heat pipe is made to have an enlarged portion with a larger outer diameter; after pressing the heat pipe, a larger surface area can be obtained, so that the heat pipe is more suitable for contacting with the heat-conducting plate or the electronic heat-generating element.

In order to achieve the above object, the present invention provides a method for manufacturing a heat pipe having an enlarged portion, comprising the steps of:

a) preparing a hollow tubular material having a uniform outer diameter;
b) forming the tubular material with an enlarged portion having a larger outer diameter by narrowing or enlarging the tubular material, and arranging a capillary structure into the tubular material;
c) filling a working fluid into the tubular material, and scaling the end of the tubular material to form a heat pipe after performing a degassing operation; and
d) pressing the enlarged portion obtained in step b) to form a flattened enlarged portion on the heat pipe.

BRIEF DESCRIPTION OF THE DRAWINGS

FIG. 4 is a schematic view of the fourth step of the present invention;

DETAILED DESCRIPTION OF THE INVENTION

In order to make the Examiner better understanding the characteristics and the technical contents of the present invention, a detailed description will be made with reference to the accompanying drawings. However, it should be understood that the drawings are illustrative but not used to limit the scope of the present invention.

Figure 1:
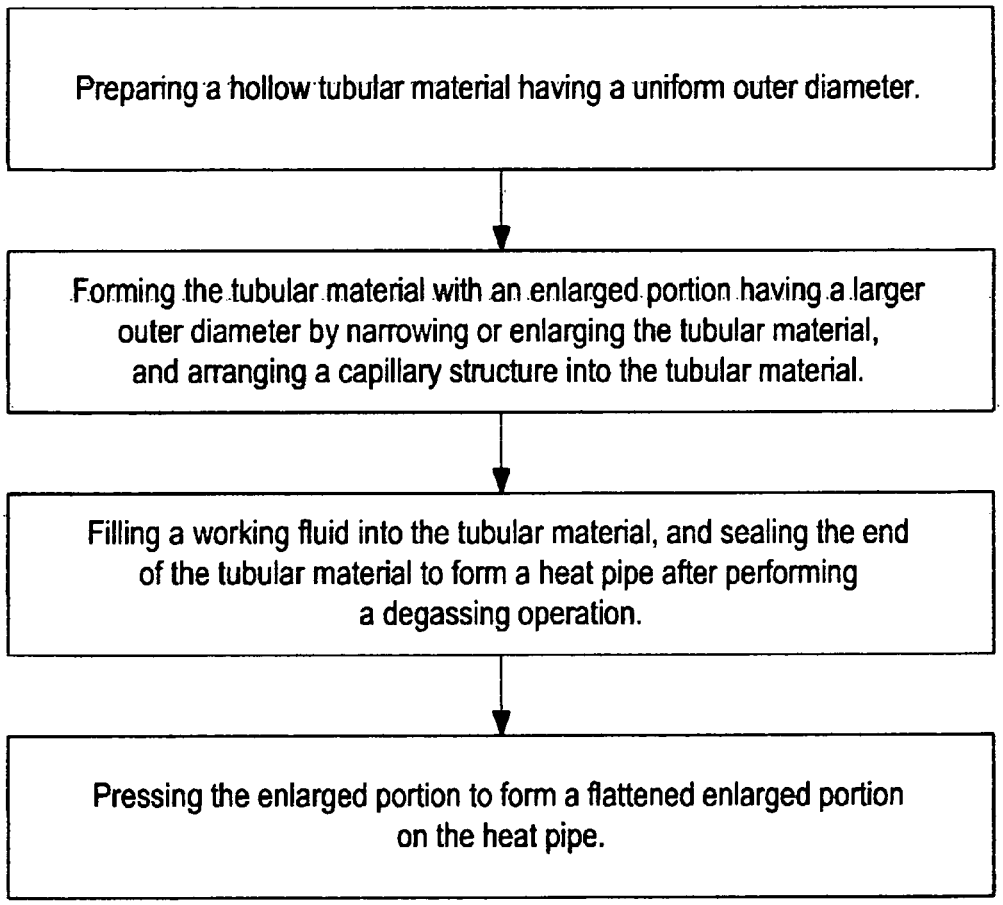
FIG. 1 is a schematic flow chart of the present invention.
Figure 2:
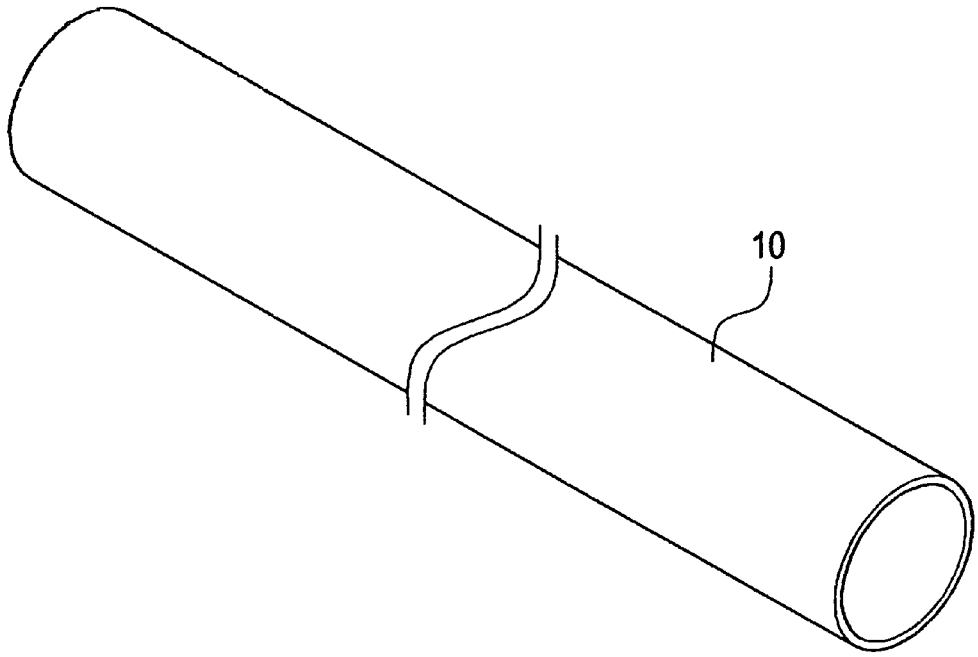
FIG. 2 is a schematic view of the first step of the present invention.
Figure 3:
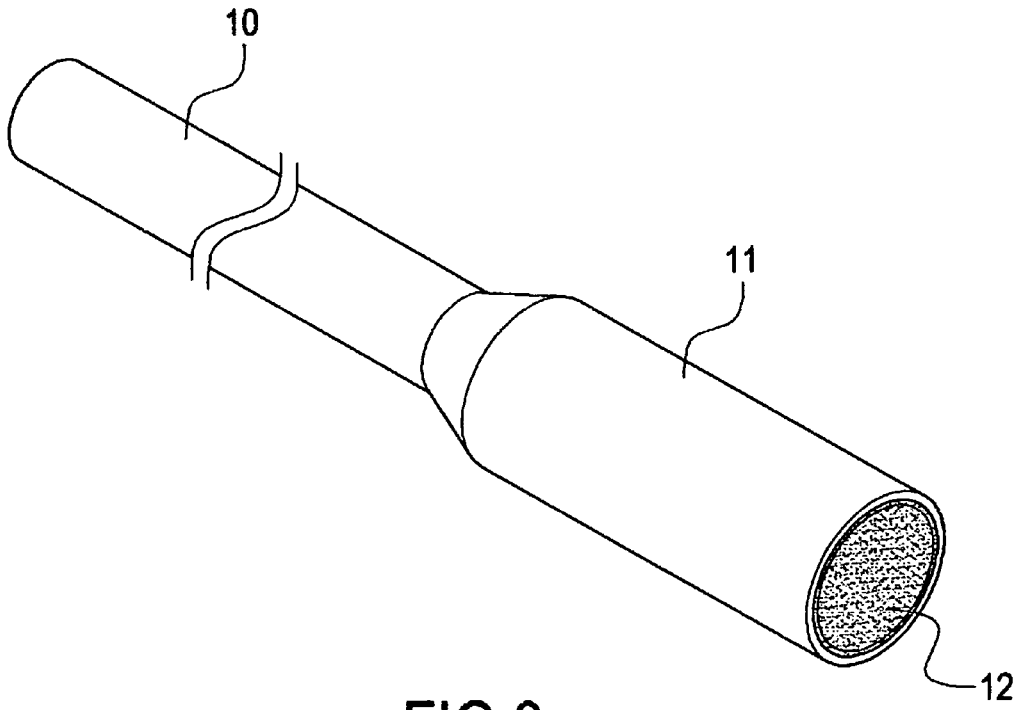
FIG. 3 is a schematic view of the second step of the present invention.
Figure 4:
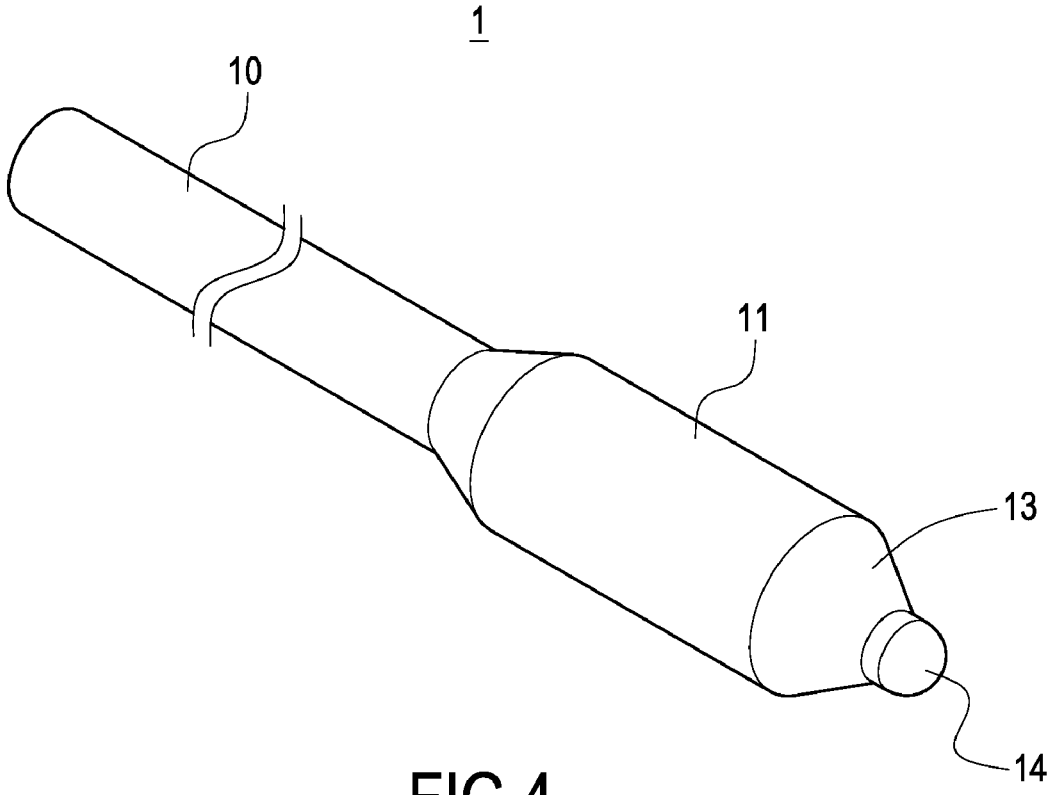
FIG. 4 is a schematic view of the third step of the present invention.
Figure 6:
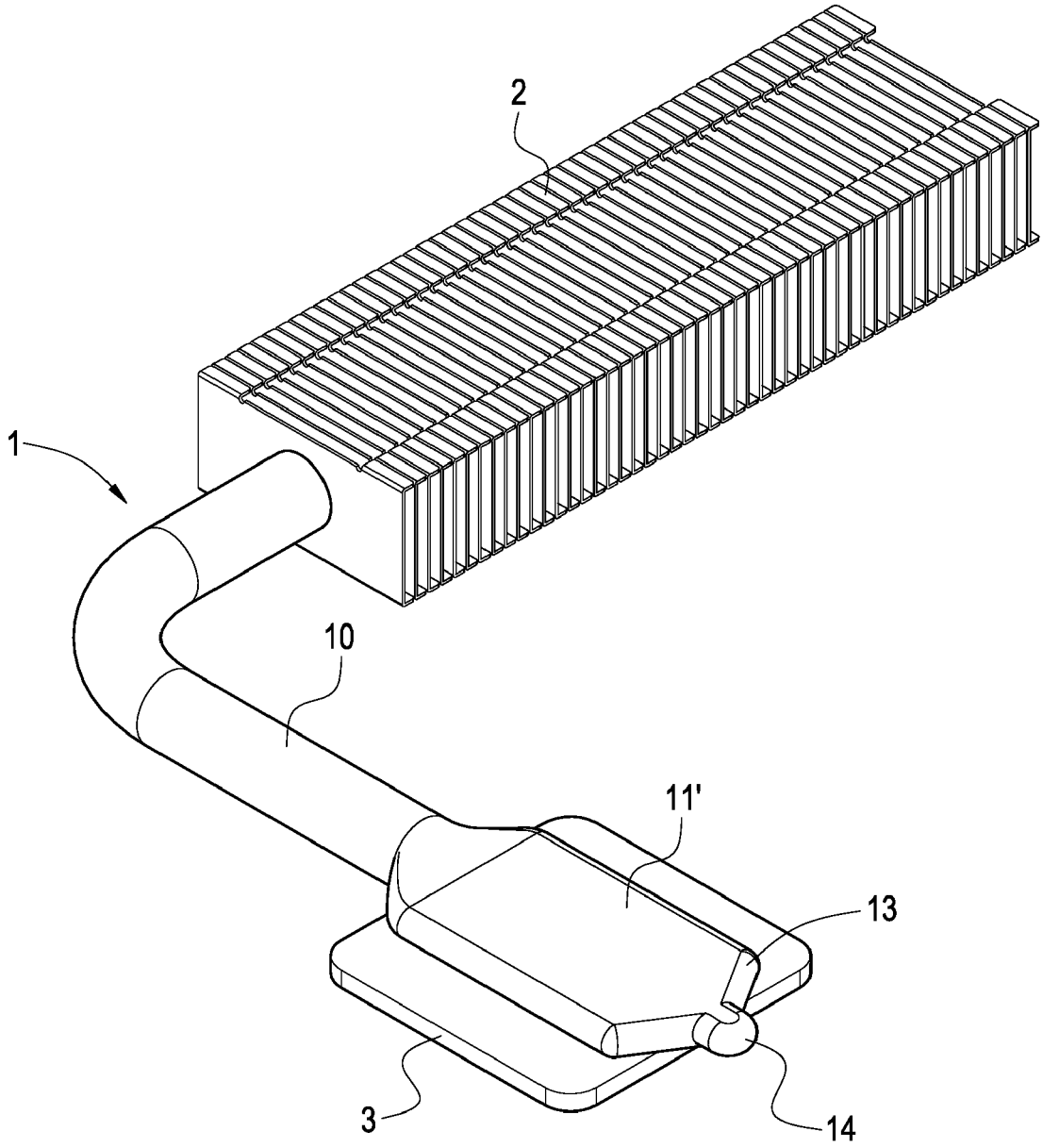
FIG. 6 is a schematic view showing the operating state of the heat pipe manufactured by the present invention.

With reference to FIGS. 1 and 6, FIG. 1 is a schematic flow chart of the present invention, and FIG. 6 is a schematic view showing the operating state of the heat pipe manufactured by the present invention. The present invention provides a method for manufacturing a heat pipe having an enlarged portion and comprises the following steps.

a) As shown in FIG. 2, a hollow tubular material 10 having a uniform outer diameter is prepared. The tubular material 10 can be a copper pipe and formed into a pipe having a uniform outer diameter by drawing. Further, the drawn pipe is cut into sections according to the desired length. After washing and cleaning, a sample tubular material 10 is ready for the subsequent process.
b) As shown in FIG. 3, the tubular material 10 is formed with an enlarged portion 11 having a larger outer diameter by narrowing or enlarging the tabular material. A capillary structure is arranged into the tubular material 10. In this step, if the outer diameter of the heat pipe to be obtained by the narrowing process is 8 mm, the outer diameter of the sample tubular material 10 should be larger than 8 mm. Then, the outer diameter of most part of the tubular material 10 is narrowed to 8 mm via the narrowing process. As a result, the un-narrowed part of the tubular material is left to form an enlarged portion. Alternatively, if the outer diameter of the heat pipe to be obtained by enlarging process is 8 mm, the outer diameter of the sample tubular material 10 is exactly identical to 8 mm. The intended part of the tubular material 10 is subjected to the enlarging process to form an enlarged portion 111 having an outer diameter larger than 8 mm. The capillary structure 12 arranged into the tubular material 10 maybe a mesh made by weaving wires or sintering powders. Incidentally, in this step, one end of the tubular material 10 should be firstly sealed and then subjected to the heat treatment for the next step. However, the sealing fall into the scope of the present invention and thus the related description is omitted.
c) As shown in FIG. 4, a working fluid is filled into the tubular material 10. The end of the tubular material is sealed to form a heat pipe 1 after performing a degassing operation. Before performing the degassing operation, the open end of the tubular material 10 is formed into a narrowed portion 13. Once the degassing operation is completed, the open end of the narrowed portion 13 is pressed and then a welding process is applied to seal the open end. As a result, a welded structure 14 is formed on the narrowed portion 13.

Figure 5:
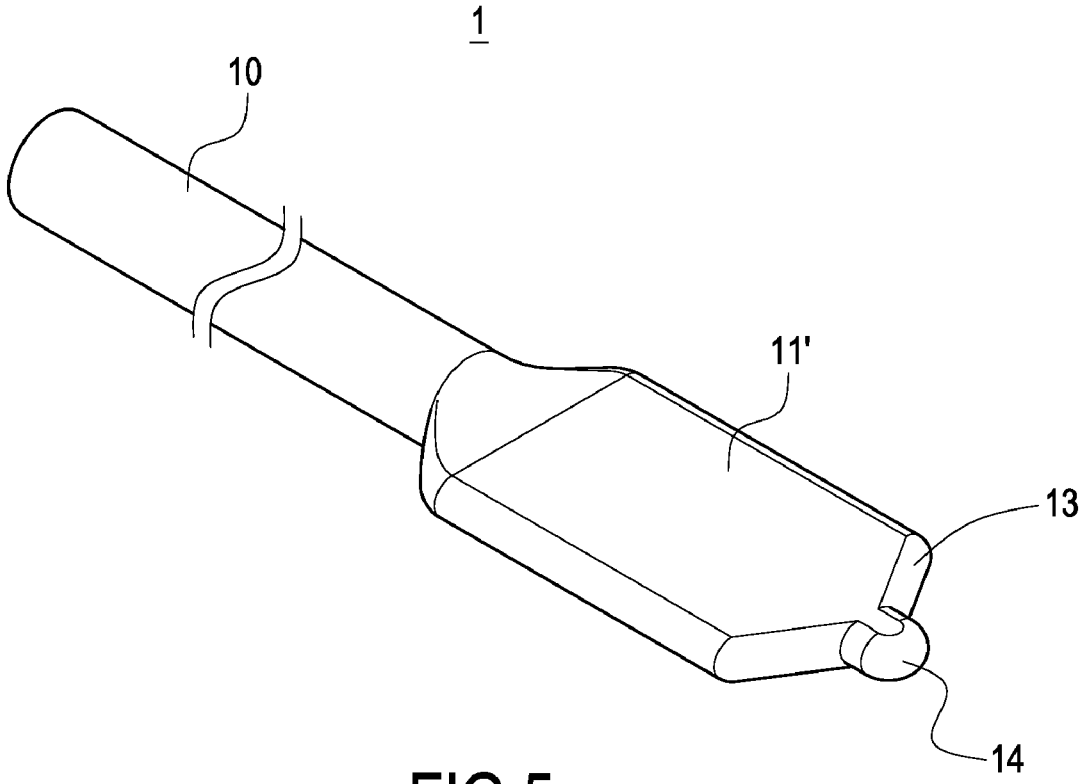

As shown in FIG. 5, a pressing process is applied to the enlarged portion obtained in step b) to form a flattened enlarged portion 11' on the heat pipe 1. Since the tubular material 10 is made of steel material. With the high extensibility of the steel material, a forming tool can be used to flatten the enlarged portion 11 by rolling, so that the thus-rolled enlarged portion 11' can have a larger surface area. Further, the entire heat pipe 1 can also be pressed if necessary (as shown in FIG. 7).

Therefore, with the above procedure, the method for manufacturing a heat pipe having an enlarged portion according to the present invention can be carried out.

Next, as shown in FIG. 6, a plurality of heat-dissipating fins 2 is provided at one end of the heat pipe 1 obtained by the above procedure. Since the other end of the heat pipe is provided with the flattened enlarged portion 11', the enlarged portion 11' having a larger surface area can be brought into contact with the surface of a heat-conducting plate 3, thereby to increase the contact area between the heat pipe 1 and the heat-conducting plate 3.

Figure 7:
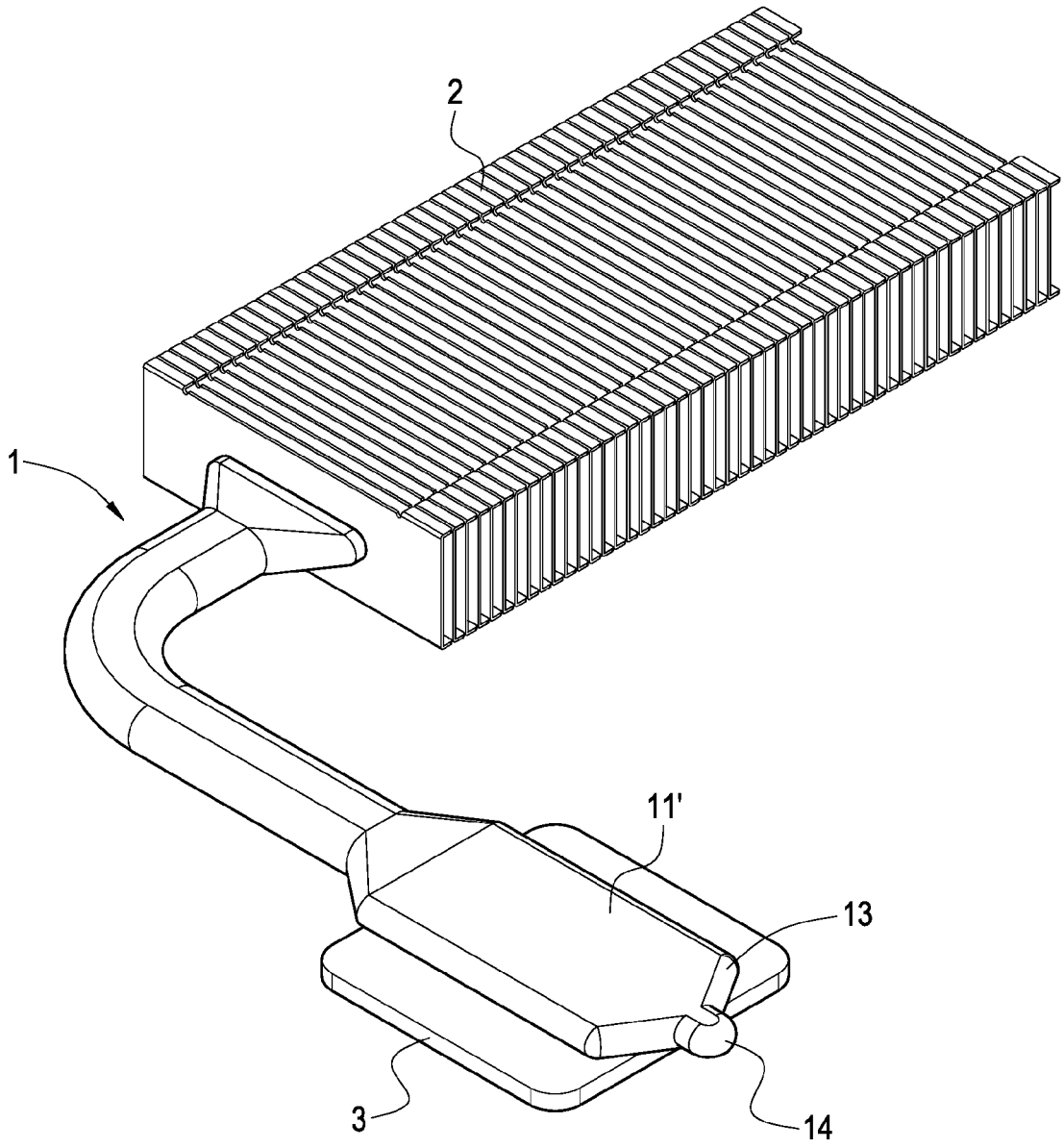
FIG. 7 is a schematic view showing the operating state of another embodiment of the heat pipe manufactured by the present invention.

Further, as shown in FIG. 7, a plurality of the enlarged portions 11' can be also provided. For example, in addition to the heated end of the heat pipe 1, the condensed end thereof can be provided with the flattened enlarged portion 11', thereby to increase the connecting area between the heat pipe 1 and the heated-dissipating fins 2.

According to the above, the present invention indeed achieves the desired effects to overcome the drawbacks of prior art. Further, the present invention really involves the novelty and inventive steps, and conforms to the requirements for an invention patent.

Although the present invention has been described with reference to the foregoing preferred embodiments, it will be understood that the invention is not limited to the details thereof. Various equivalent variations and modifications can still be occurred to those skilled in this art in view of the teachings of the present invention. Thus, all such variations and equivalent modifications are also embraced within the scope of the invention as defined in the appended claims.

What is claimed is:

1. A method for manufacturing a heat pipe having an enlarged portion, comprising the steps in the sequence set forth:

a) preparing a hollow tubular material having two ends and a uniform outer diameter;

b) forming the tubular material with an enlarged portion having a larger outer diameter by narrowing or enlarging the tubular material, arranging a capillary structure into the tubular material, and sealing one end of the tubular material;

c) filling a working fluid into the tubular material;

d) sealing another open end of the tubular material to form a heat pipe after performing a degassing operation to remove air remained inside the tubular material; and e) pressing the enlarged portion obtained in step b) to form a flattened enlarged portion on the heat pipe.

2. The method for manufacturing a heat pipe having an enlarged portion according to claim 1, wherein the tubular material used in step a) is made of a copper material.

3. The method for manufacturing a heat pipe having an enlarged portion according to claim 1, wherein the narrowing process mentioned in step b) is performed to narrow the outer diameter of the tubular material, so that a predetermined part of the tubular material is kept un-narrowed to form the enlarged portion mentioned in step b).

4. The method for manufacturing a heat pipe having an enlarged portion according to claim 1, wherein the enlarging process mentioned in step b) is performed to enlarge the outer diameter of the tubular material, thereby to form the enlarged portion mentioned in step b).

5. The method for manufacturing a heat pipe having an enlarged portion according to claim 1, wherein the capillary structure arranged in step b) is a mesh made by weaving wires.

6. The method for manufacturing a heat pipe having an enlarged portion according to claim 1, wherein the capillary structure arranged in step b) is a mesh made by sintering powders.

7. The method for manufacturing a heat pipe having an enlarged portion according to claim 1, wherein before the degassing operation is performed in step d), the open end of the tubular material is formed into a narrowed portion, once the degassing operation is completed, the narrowed portion is pressed and a welding process is performed to seal the open end.

8. The method for manufacturing a heat pipe having an enlarged portion according to claim 1, wherein the entire heat pipe can also be pressed simultaneously in step e).

* * * * *